US007128527B2

(12) United States Patent
Jonsson

(10) Patent No.: US 7,128,527 B2
(45) Date of Patent: Oct. 31, 2006

(54) GAS TURBINE STATOR

(75) Inventor: Bertil Jonsson, Bjarred (SE)

(73) Assignee: Volvo Aero Corporation, Trollhätan (SE)

( * ) Notice: Subject to any disclaimer, the term of this patent is extended or adjusted under 35 U.S.C. 154(b) by 0 days.

(21) Appl. No.: 10/249,898

(22) Filed: May 15, 2003

(65) Prior Publication Data

US 2003/0165384 A1 Sep. 4, 2003

Related U.S. Application Data

(63) Continuation of application No. PCT/SE01/02057, filed on Sep. 25, 2001, now abandoned.

(30) Foreign Application Priority Data

Nov. 15, 2000 (SE) ..... 0004215

(51) Int. Cl.
*F01B 25/02* (2006.01)

(52) U.S. Cl. ..... 415/159; 415/150

(58) Field of Classification Search ..... 415/150, 415/159, 160, 161, 162
See application file for complete search history.

(56) References Cited

U.S. PATENT DOCUMENTS

| | | | |
|---|---|---|---|
| 4,618,311 | A | 10/1986 | Miura et al. |
| 4,810,165 | A | 3/1989 | Greune et al. |
| 5,215,434 | A | 6/1993 | Greune et al. |
| 5,672,047 | A | 9/1997 | Birkholz |

FOREIGN PATENT DOCUMENTS

DE 2029859 A1 2/1972

*Primary Examiner*—Edward K. Look
*Assistant Examiner*—Dwayne J White
(74) *Attorney, Agent, or Firm*—Novak Druce & Quigg, LLP

(57) ABSTRACT

Stator (1) for a gas turbine including a stator structure (2) having a continuous through-duct (3) for a gas through-flow, a circumferential member (6), which is arranged at a radial distance from the stator structure and is operatively coupled to the stator structure, and at least one member for maintaining the distance between the stator structure and the circumferential member. The spacing member has resilient characteristics in the radial direction of the stator.

14 Claims, 2 Drawing Sheets

GAS TURBINE STATOR

CROSS REFERENCE TO RELATED APPLICATIONS

The present application is a continuation patent application of International Application No. PCT/SE01/02057 filed Sep. 25, 2001 which was published in English pursuant to Article 21(2) of the Patent Cooperation Treaty and which claims priority to Swedish Patent Application No. 0004215-0 filed Nov. 15, 2000. Both applications are expressly incorporated herein by reference in their entireties.

BACKGROUND OF INVENTION

The present invention relates to a stator for a gas turbine comprising (including) a stator structure having a continuous through-duct for a gas through-flow, a circumferential member, which is arranged at a radial distance from the stator structure and is operatively coupled to the stator structure, and at least one member for maintaining the distance between the stator structure and the circumferential member.

The term gas turbine is intended to mean a unit, which comprises at least one turbine and a compressor driven by the former, together with a combustion chamber. Gas turbines are used, for example as engines for vehicles and aircraft, as prime movers for vessels and in power stations for producing electricity.

The gas turbine is of the axial type and has one or more turbine stages. The stator comprises a plurality of stator blades disposed in the duct for guiding the gas flow. The invention will be explained below in an application in which the stator consists of a so-called variable stator in a gas turbine. The term variable stator is intended to signify that the stator blades can be adjusted to various positions.

In order to achieve good efficiency in a gas turbine it is desirable to keep the inlet temperature to the first turbine stage as high as is feasible throughout as large a part of the operating range as possible. By means of the variable stator, it is possible to vary the pressure gradient over preceding turbine stages (the compressor turbine), and hence also the inlet temperature to the compressor turbine.

DESCRIPTION OF THE STATE OF THE ART

By conventional design, a variable stator comprises an arrangement for adjusting the stator blades to various positions. The adjusting arrangement typically comprises a circumferential member in the form of a toothed ring. The toothed ring is of rotatable design and can be operated, for example, by means of a hydraulic servo cylinder. The adjusting arrangement further comprises a plurality of adjusting elements shaped with corresponding shaped toothed sections at a distance from one another in the circumferential direction of the circumferential member and in engagement with the toothed ring. Each of the adjusting elements is connected to one of the guide blades and is rotated by a rotation of the toothed ring. In this way the blades are moved between the positions.

The ability of the toothed ring to rotate is achieved by the toothed ring being supported on an inner ring. The surface of the inner ring facing the toothed ring in the radial direction of the stator is provided with a low-friction coating. The inner ring is further supported on a plurality of pins that protrude radially from the stator structure.

In operation of the gas turbine, the stator structure attains a higher temperature than the toothed ring due to the fact that the stator structure is in direct contact with the working gas. The temperature differential between the stator structure and the toothed ring causes the stator structure to expand more than the toothed ring. Most of the difference in expansion is taken up by a sliding displacement between the pins and the inner ring.

Problems do, however, occur in dimensioning the clearance between the toothed ring and the inner ring. Furthermore, there is a risk of the parts heating up asymmetrically. One of the rings may then take on an oval shape. This can affect the tooth clearance and may cause the toothed ring to jam in its bearing, or the bearing to acquire excessive clearance.

SUMMARY OF INVENTION

A first objective of the invention is to produce a stator for a gas turbine that eliminates, or at least reduces problems associated with different rates of thermal expansion between a stator structure having a continuous through-duct for a gas through-flow, and a circumferential member that is arranged at a radial distance from the stator structure and is operatively coupled to the stator structure.

This objective is achieved in that the spacing member has resilient characteristics in the radial direction of the stator. This means that the spacing member has the capacity for at least partial compression when the distance between the stator structure and the circumferential member is reduced, and for expansion when the distance between the stator structure and the circumferential member increases. Through suitable choice of material and suitable dimensioning, it is possible to produce a controlled relative movement between these parts in the radial direction of the stator, thereby at least reducing the above-mentioned problems with the tooth clearance and bearing.

According to a preferred embodiment, the stator comprises a plurality of spacing members, which are arranged at a distance from one another in the circumferential direction of the circumferential member, and at least one of these spacing members having the resilient characteristics described above. The prerequisites are thereby created for a stable and accurate movement. According to one particular exemplary embodiment, the stator comprises three spacing members that are arranged at a distance from one another, preferably equi-distances, in the circumferential direction of the circumferential member, and at least one of the spacing members has the described resilient characteristics, and preferably, all such members have these resilient qualities.

In an exemplary embodiment, the spacing member having resilient characteristics comprises an energy storage element, which best consists of a spring element.

According to another embodiment, the spacing member comprises a moving element in the form of a roller or a wheel, which is arranged for moving in contact with and along one of the stator structure and the circumferential member. In a preferred embodiment of this configuration, all spacing members have such a roller. Through suitable choice of the number of spacing members and the distance between the spacing members, it is possible to achieve a desired relative movement between the circumferential member and the stator structure, during which the rollers roll against the circumferential member, for example.

According to another embodiment, which is a further development of the preceding embodiment, the spacing member is designed in such a way that the circumferential member is arranged eccentrically in relation to the stator structure when the stator structure is not under load and essentially concentrically in relation to the stator structure when the stator structure is under load. This can be achieved, for example, in that the stator comprises three spacing members, which are each provided with the rollers, and one of which spacing members comprises the spring element. This embodiment creates the prerequisites for a very precise movement into the concentric operating position.

BRIEF DESCRIPTION OF DRAWINGS

The invention will be described in more detail below with reference to the embodiment shown in the drawings attached.

DETAILED DESCRIPTION

Figure 1:
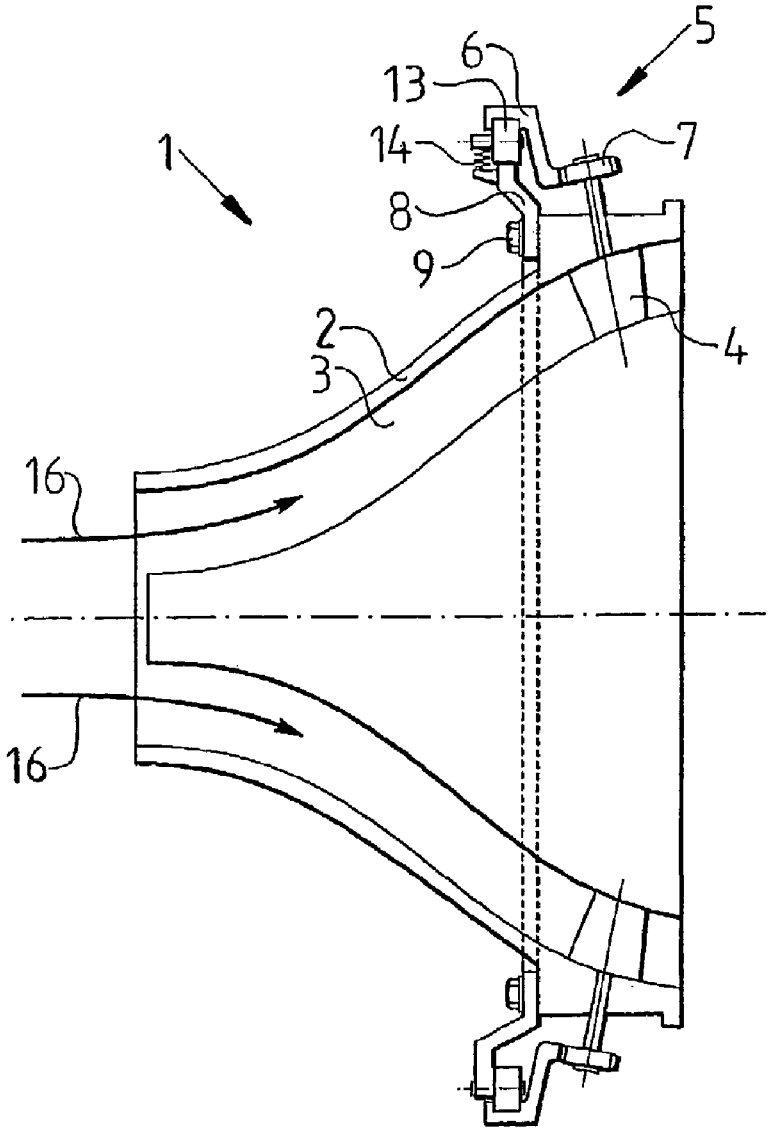
FIG. 1 is a partial cutaway side view of a stator configured according to a preferred embodiment of the presently disclosed invention.

FIG. 1 shows a diagrammatic side view of a stator 1 in a gas turbine. The stator 1 comprises a stator structure 2 having a continuous through-duct 3 for a gas through-flow that is indicated by the arrows 16. A plurality of stator blades 4, located in the duct, are designed for guiding the gas flow.

Figure 2:
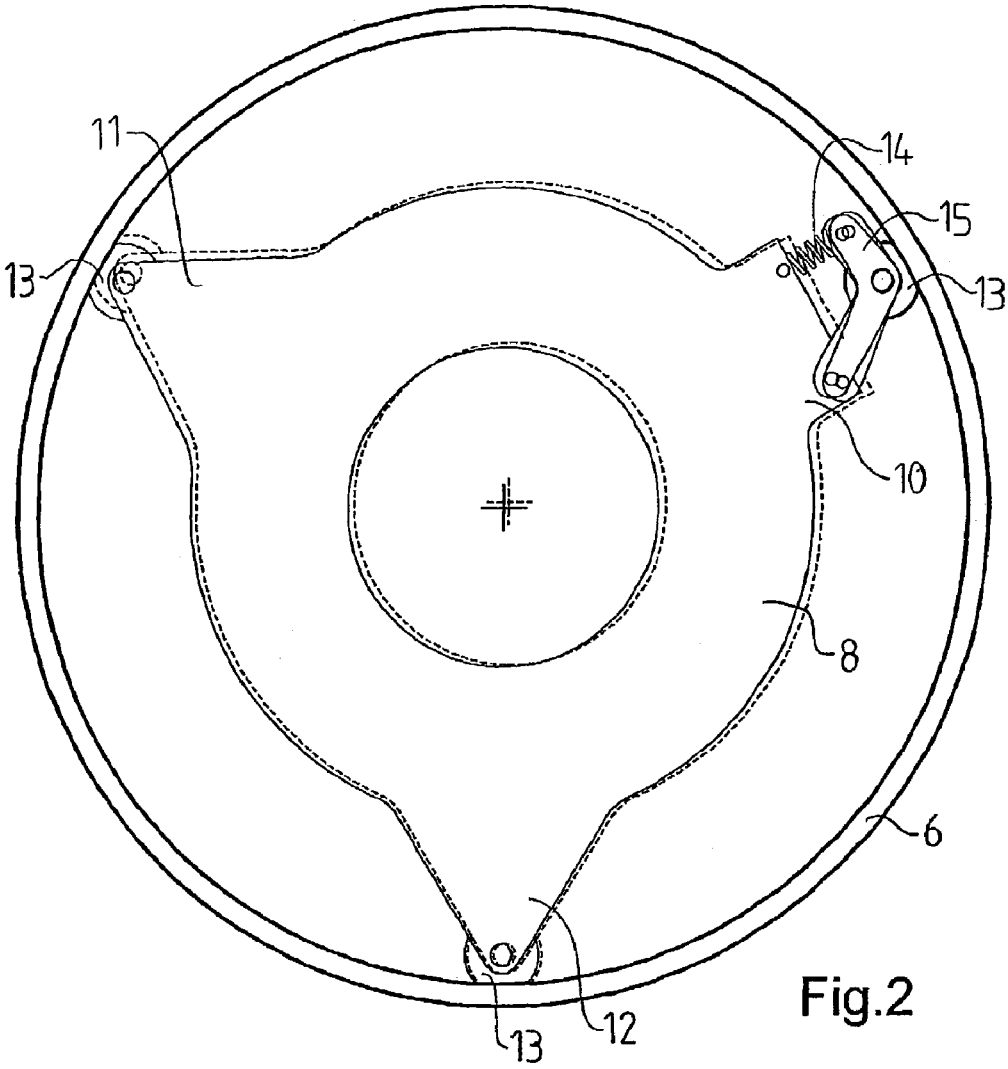
FIG. 2 is a diagrammatic front (longitudinal) view of a stator, according to the preferred embodiment, in two different positions.
Figure 3:
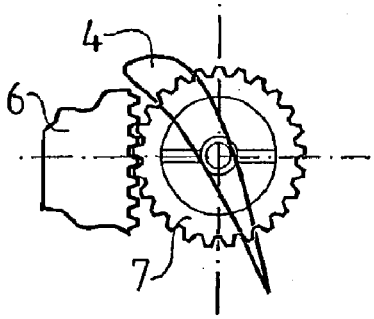
FIG. 3 is a side diagrammatic view of an adjustment mechanism for adjusting the positions of the stator blades.

As shown in FIGS. 2 and 3, the stator 1 comprises (includes, but is not limited to) an arrangement 5 for adjusting the stator blades 4 to various positions. The adjusting arrangement 5 comprises a circumferential or surrounding member 6 in the form of a toothed ring. For the sake of simplicity, the circumferential member 6 will hereafter be referred to as toothed ring 6. The toothed ring 6 is arranged at a radial distance outside the stator structure 2. The toothed ring 6 is of rotatable design and is operated by means of a hydraulic servo cylinder that is not shown.

The adjusting arrangement 5 further comprises a plurality of adjusting elements 7 having toothed sections that correspond to the toothing shape of the toothed ring 6. Each of the adjusting elements 7 is fixed to one of the guide blades 4. The adjusting elements 7 are arranged at a distance from one another in the circumferential direction of the toothed ring 6 and are in engagement therewith. The adjusting elements 7 are therefore rotated by a rotation of the toothed ring 6 and the stator blades 4 are thereby moved between the positions.

The stator structure 2 comprises an annular, projecting section 8. According to the illustrated preferred embodiment, this annular section 8 consists of a separate part, which is fixed to the rest of the stator structure 2 by means of a bolted connection 9.

Three members 10, 11, and 12 project radially from the annular section 8 in order to maintain the distance between the stator structure 2 and the toothed ring 6 (see FIG. 2). The spacing members 10–12 are arranged with an essentially equal angular displacement in relation to one another. Each of the spacing members 10–12 comprises a roller 13 arranged in contact with a radially inner surface of the toothed ring 6 in order to roll along the latter. A first spacing member 10 is additionally provided with an energy storage member 14 in the form of a spring element. The energy storage element 14 in the first spacing member 10 is connected to the moving element 13 by way of an arm 15, on which the moving element 13 is supported. The arm 15 is in turn pivoted in relation to the annular section 8.

When hot gas flows through the duct of the stator structure 2, the stator structure is heated up and expands. As the stator structure 2 cools after exposure to the gas, the stator structure contracts again. Because the stator structure 2 is in direct contact with the gas, it expands and contracts more than the toothed ring. In order to remedy this difference in thermal expansion, the spring element 14 is biased in such a way that the rollers 13 are in contact with the inner surface of the toothed ring 6 both when the stator is in the operating position and when it is not in the operating position. In FIG. 2, the position of the annular section 8 when the stator is in the operating position is indicated by dashed lines, and when the stator is not in the operating position by solid lines. The spring element 14 consists, more specifically, of a stack of spring washers arranged in such a way that it springs in the radial direction of the stator. That is to say, the toothed ring 6 is arranged somewhat eccentrically in relation to the stator structure 2 when the latter is not under load and essentially concentrically in relation to the stator structure 2 when the latter is under load.

In order to be able to easily adjust the displacement of the toothed ring 6, the position of the rollers 13 may be adjustable, for example, by means of an eccentric shaft (not shown), the position of which is determined after measuring the eccentricity of the toothed ring when the stator is in a hot state.

FIG. 3 shows a part of the arrangement 5 for adjustment of the stator blades 4. More specifically, FIG. 3 shows the toothed ring 6, one of the adjusting elements 7 with toothed sections that correspond to the toothing shape of the toothed ring 6, and the stator blade 4, which is fixed to the adjusting element 7.

The term resilient is defined to mean that the energy storage member yields pliably to a pressure loading and returns to its original shape when the pressure loading is reduced.

The term circumference is intended to signify an inner or outer edge of an object in one plane, and is not limited to a circular shape.

The first spacing member 10 described above has resilient characteristics in the radial direction of the stator 1. This, of course, does not mean that the spacing member 10 is confined to having resilient characteristics in the radial direction of the stator 1; it may also have resilient characteristics in other directions.

The gas turbine may be of both single-shaft and twin-shaft type. The term single-shaft gas turbine means that the compressor or the compressors is/are connected to the drive turbine by way of a shaft, the drive turbine being connected to an output shaft. The combustion chamber is situated between the compressor(s) and the drive turbine. The term twin-shaft gas turbine means that the compressor or compressors is/are connected to a compressor turbine by way of a shaft. The drive turbine is not mechanically connected to the compressor turbine, but is situated downstream of the compressor turbine in the direction of flow of the gas and connected to an output shaft. Here, the combustion chamber is situated between the compressor and the compressor turbine.

The embodiment described must only be regarded as a preferred example and a number of other variants and modifications are conceivable within the scope of the claims set out below.

In an alternative to the stack of spring washers, the energy storage member can take the form of a coil spring. According to a first example, the coil spring is arranged so that its center axis extends essentially in the radial direction of the stator. According to a second example, the coil spring is arranged with its center axis essentially in the axial direction of the stator. In such a case, the spacing member comprises a part connected to the spring and displaceable in the axial direction. A section of this part interacts with the toothed ring in such a way that a radial displacement between the toothed ring and the stator structure is resiliently taken up by the part in the direction of the center axis of the spring.

In a further alternative, the energy storage member consists of a piston, for example a pneumatic piston, in which the working medium (the air) constitutes the spring element. In a further alternative, the energy storage member consists of a body of elastic material, such as a rubber material. That is to say, in the latter alternative, the resilient characteristics derive from the internal structure of the material and not from the form of the energy storage member.

In an alternative to the moving element in the form of a roller, the element is instead designed to move by sliding along the toothed ring 6. The moving element then consists of, for example, a curved rail.

In an alternative to the annular section 8 in the form of a separate part that is fixed to the rest of the stator structure by means of a bolted connection 9, the annular section may naturally consist of a part formed integrally with the rest of the stator structure.

In an alternative to the tooth engagement between the adjusting elements and the circumferential member, the adjusting elements consist of rollers, which roll against an inner surface of the circumferential member. In a further alternative, the circumferential member is provided with grooves or recesses. The grooves or recesses are situated, for example, in a radially outer surface of the circumferential member and at a distance from one another in the circumferential direction. The grooves extend transversely to the main plane of the circumferential member. The adjusting elements consist of an arm, which at one end is fixed to the stator blade, and at the other end rests in the groove. The arm may, for example, have a spherical part at its other end, the ball in turn resting in the groove. Turning of the circumferential member thereby also causes the stator blades to turn.

In an alternative to the embodiment described, in which only one of the spacing members is provided with a spring element, more than one of them is provided with a spring element. For example, the stator may comprise four spacing members. Two of these are provided with spring elements. The spacing members are arranged in such a way that the resultant of the spring elements acts in the same direction as if there were three legs, one of which is provided with a spring element.

The applications of the invention described above, in which there are differences in thermal expansion between the toothed ring and the stator structure, must not be regarded as limiting the invention, the invention rather being applicable also in other areas in which a circumferential member is operatively coupled to the stator structure.

The invention claimed is:

1. A stator for a gas turbine comprising: a stator structure having a continuous through-duct for a gas through-flow; a circumferential member arranged at a radial distance from the stator structure and that is operatively coupled to the stator structure; and three spacing members arranged at a distance from one another in a circumferential direction of the circumferential member and that maintain a distance between the stator structure and the circumferential member, and at least one of the three spacing members being resilient in a radial direction of the stator.

2. A stator for a gas turbine comprising: a stator structure having a continuous through-duct for a gas through-flow; a circumferential member arranged at a radial distance from the stator structure and that is operatively coupled to the stator structure; and at least one spacing member that maintains a distance between the stator structure and the circumferential member and being resilient in a radial direction of the stator and wherein the spacing member comprises a moving element arranged for following along the stator structure.

3. A stator for a gas turbine comprising: a stator structure having a continuous through-duct for a gas through-flow; a circumferential member arranged at a radial distance from the stator structure and that is operatively coupled to the stator structure; and at least one spacing member that maintains a distance between the stator structure and the circumferential member and being sufficiently resilient in a radial direction of the stator to maintain said spacing during turbine operation, wherein the spacing member is configured so that the circumferential member is arranged eccentrically in relation to the stator structure when the stator structure is not under load, and is arranged essentially concentrically in relation to the stator structure when the stator structure is under load.

4. A stator for a gas turbine comprising: a stator structure having a continuous through-duct for a gas through-flow; a circumferential member arranged at a radial distance from the stator structure and that is operatively coupled to the stator structure; and at least one spacing member that maintains a distance between the stator structure and the circumferential member and being resilient in a radial direction of the stator; a plurality of blades disposed in the through-duct for guiding the gas flow; an adjustment arrangement for adjusting the blades into at least two different positions, the adjusting arrangement comprising the circumferential member that is rotatable with respect to the stator structure; and a plurality of rotatable adjusting elements positioned at a distance from one another in the circumferential direction of the circumferential member and each of which is respectively connected to one of the guide blades and is arranged in contact with the circumferential member so that when the adjusting element is rotated by rotation of the circumferential member, the guide blades are moved between positions and wherein the circumferential member and the adjusting elements have corresponding shaped toothed sections for producing movement of the blades.

5. A stator for a gas turbine comprising: a stator structure and a surrounding member that is circumferentially disposed thereabout, the stator structure and the surrounding member undergoing different shape changes during the course of operation of the gas turbine so that variable spacing results between the stator structure and the surrounding member during the course of operation of the gas turbine; and a resilient spacing member attaching the surrounding member to the stator structure and adapted to accommodate the variable spacing caused between the stator structure and the surrounding member during the course of operation of the gas turbine, the resilient spacing member comprising an energy storage element in the form of a spring comprising a stack of spring washers.

6. A stator for a gas turbine comprising: a stator structure having a continuous through-duct for a gas through-flow; a circumferential member arranged at a radial distance from the stator structure and that is operatively coupled to the stator structure; and at least one spacing member that maintains a distance between the stator structure and the circumferential member and being resilient in a radial direction of the stator and wherein the resilient spacing member comprises a moving element arranged for following along an exterior of the stator structure.

7. A stator for a gas turbine comprising: a stator structure and a surrounding member that is circumferentially disposed thereabout, the stator structure and the surrounding member undergoing different shape changes during the course of operation of the gas turbine so that variable spacing results between the stator structure and the surrounding member during the course of operation of the gas turbine; and a resilient spacing member attaching the surrounding member to the stator structure and adapted to accommodate the variable spacing caused between the stator structure and the surrounding member during the course of operation of the gas turbine, wherein the resilient spacing member is configured so that the surrounding member is eccentrically arranged in relation to the stator structure when the stator structure is not under load, and is arranged essentially concentrically in relation to the stator structure when the stator structure is under load.

8. The stator as recited in any one of claims 2, 3, 4, 5, 6, and 7 further comprising: a plurality of spacing members arranged at a distance from one another in a circumferential direction of the circumferential member.

9. The stator as recited in any one of claims 1, 2, 3, 4, 5, 6, and 7 wherein each spacing member further comprises an energy storage element.

10. The stator as recited in claim 9, wherein the energy storage element consists of a spring element.

11. The stator as recited in any one of claims 2 and 6, wherein the moving element consists of one of a roller and a wheel.

12. The stator as recited in any one of claims 1, 2, 3, 4, 5, 6, and 7 wherein each spacing member is fixed to one of the stator structure and the circumferential member.

13. The stator as recited in any one of claims 1, 2, 3, 4 and 6 further comprising: a plurality of blades disposed in the through-duct for guiding the gas flow; an adjustment arrangement for adjusting the blades into at least two different positions, the adjusting arrangement comprising the circumferential member that is rotatable with respect to the stator structure; and a plurality of rotatable adjusting elements positioned at a distance from one another in the circumferential direction of the circumferential member and each of which is respectively connected to one of the guide blades and is arranged in contact with the circumferential member so that when the adjusting element is rotated by rotation of the circumferential member, the guide blades are moved between positions.

14. The stator as recited in any one of claims 1, 2, 3, 4, 5, 6, and 7 wherein the gas turbine is adapted to propel a vehicle.

* * * * *